US008079639B2

(12) United States Patent
Zeng et al.

(10) Patent No.: US 8,079,639 B2
(45) Date of Patent: Dec. 20, 2011

(54) BOUNCER

(75) Inventors: Hai-Bo Zeng, Taipei (TW); Sharon A. Gillett, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 303 days.

(21) Appl. No.: 12/436,135

(22) Filed: May 6, 2009

(65) Prior Publication Data

US 2009/0284051 A1 Nov. 19, 2009

Related U.S. Application Data

(60) Provisional application No. 61/083,511, filed on Jul. 24, 2008, provisional application No. 61/127,935, filed on May 16, 2008.

(51) Int. Cl.
*A47C 3/02* (2006.01)

(52) U.S. Cl. ..... 297/131; 297/133; 297/270.1; 297/270.4; 297/259.1; 297/DIG. 11; 5/655

(58) Field of Classification Search ..... 297/131–133, 297/270.1–270.4, 271.6, 452.13, DIG. 11, 297/258.1, 259.1, 270.3, 271.1, 271.3, 271.5; 5/101, 104–107, 655
See application file for complete search history.

(56) References Cited

U.S. PATENT DOCUMENTS

| | | | | | |
|---|---|---|---|---|---|
| 379,959 | A | * | 3/1888 | Knieper | 297/131 |
| 394,010 | A | * | 12/1888 | Powers | 5/99.1 |
| 584,529 | A | * | 6/1897 | Starcher | 297/131 |
| 715,346 | A | * | 12/1902 | Brubaker | 297/33 |
| 927,234 | A | * | 7/1909 | Haley | 297/270.3 |
| 2,558,466 | A | * | 6/1951 | Simard et al. | 297/131 |
| 3,804,459 | A | * | 4/1974 | Nose | 297/271.6 |
| 5,178,438 | A | * | 1/1993 | Beger | 297/271.6 |
| 5,203,611 | A | | 4/1993 | Greenwood | |
| 5,246,268 | A | * | 9/1993 | Lerner et al. | 297/133 |
| 5,411,315 | A | | 5/1995 | Greenwood | |
| 5,507,564 | A | * | 4/1996 | Huang | 297/452.13 |
| 5,509,721 | A | * | 4/1996 | Huang | 297/452.13 |
| 5,956,786 | A | * | 9/1999 | Huang | 5/105 |
| 6,026,524 | A | * | 2/2000 | Barger | 5/93.1 |
| 6,283,546 | B1 | * | 9/2001 | Hill | 297/271.1 |
| 6,594,840 | B2 | * | 7/2003 | Tomas et al. | 5/655 |
| 6,616,237 | B2 | | 9/2003 | Sonner et al. | |
| 6,679,779 | B2 | * | 1/2004 | Tai et al. | 472/95 |
| 6,682,137 | B2 | | 1/2004 | Hsia | |
| 6,739,649 | B2 | * | 5/2004 | Kelly et al. | 297/16.1 |

(Continued)

FOREIGN PATENT DOCUMENTS

| | | | |
|---|---|---|---|
| CN | 200956947 | Y | 10/2007 |
| CN | 201119651 | Y | 9/2008 |
| DE | 3427 755 | A1 | 1/1986 |
| JP | 200580894 | A | 3/2005 |

*Primary Examiner* — Laurie Cranmer
(74) *Attorney, Agent, or Firm* — Winston Hsu; Scott Margo

(57) ABSTRACT

A bouncer includes a seat, a first connecting member, a support member, and an engaging member. The first connecting member has a first end and a second end. The first end of the first connecting member is connected to the seat. The support member is rotatably connected to the second end of the first connecting member. The engaging member is movably disposed in the support member and capable of moving between a locked position and an unlocked position, so as to selectively restrain the support member from rotating. Accordingly, the bouncer of the invention can be operated in different using states.

18 Claims, 12 Drawing Sheets

U.S. PATENT DOCUMENTS 6,811,217 B2 * 11/2004 Kane et al. ..... 297/270.2
6,877,802 B2 * 4/2005 Christensen et al. ..... 297/16.1
7,506,922 B2 * 3/2009 Schulte et al. ..... 297/131
7,779,490 B2 * 8/2010 Bergkvist ..... 5/101

* cited by examiner

BOUNCER

CROSS REFERENCE TO RELATED APPLICATIONS

This application claims the benefits of U.S. Provisional Applications No. 61/127,935, which was filed on May 16, 2008 and No. 61/083,511, which was filed on Jul. 24, 2008, and are incorporated herein by reference.

BACKGROUND OF THE INVENTION

1. Field of the Invention

The invention relates to a bouncer and, more particularly, to a bouncer equipped with a reversible support member, such that the bouncer can rock on a plane or stand on the plane in static state.

2. Description of the Prior Art

For a parent or other care giver, a bouncer is a practical tool for securing infants. In general, the bouncer can be operated by the parent or care giver to safely bounce, rock and play.

A conventional bouncer usually has a bottom leg frame with single function. The bottom leg frame can only support the conventional bouncer on a plane in static state but cannot be operated to rock. Currently there are bouncers capable of rocking or bouncing on the market using kickstand that lock in place to maintain a stationary position. If a user wants to rock the bouncer, he or she has to release or detach the kickstand from the bouncer. The user operations therefore become inconvenient and the structure and assembly of the bouncer are complicated. Thus, it is necessary to design a bouncer that can rock, as well as bounce, and that is easy to operate.

SUMMARY OF THE INVENTION

An objective of the invention is to provide a bouncer equipped with a reversible support member, such that the bouncer can rock on a plane or stand on the plane in static state.

According to an embodiment, the bouncer of the invention comprises a seat, a first connecting member, a support member, and an engaging member. The first connecting member has a first end and a second end. The first end of the first connecting member is connected to the seat. The support member is rotatably connected to the second end of the first connecting member. The engaging member is movably disposed in the support member and capable of moving between a locked position and an unlocked position so as to selectively restrain the support member from rotating.

In this embodiment, the bouncer can comprise a driving member movably disposed on the support member. The driving member is capable of driving the engaging member to move from the locked position to the unlocked position. The bouncer can further comprise a second connecting member connecting the driving member and the engaging member. The bouncer can further comprise an axle member disposed in the support member and connected to the second end of the first connecting member. The engaging member is engaged with the axle member at the locked position so as to restrain the support member from rotating with respect to the axle member. The axle member has an engaging groove and the engaging member has an engaging portion. The engaging portion of the engaging member is engaged with the engaging groove of the axle member while the engaging member is located at the locked position. The bouncer can further comprise a sleeve disposed in the support member. The axle member is disposed in the sleeve, the sleeve is capable of rotating with respect to the axle member, and the engaging member is movably disposed in the sleeve. The bouncer can further comprise a resilient member disposed between the engaging member and an inner end of the sleeve. The resilient member provides an elastic force for forcing the engaging member to move toward the locked position. The bouncer can further comprise a cover disposed on one end of the support member. The second end of the first connecting member passes through the cover and is connected to the axle member. Furthermore, the support member has a flat surface and a cambered surface opposite to the flat surface. The bouncer can further comprise a skidproof member disposed on the flat surface of the support member. The cambered surface of the support member has a block portion formed thereon.

According to another embodiment, the bouncer of the invention comprises a seat, a connecting member, an axle member, and a support member. The connecting member has a first end and a second end. The first end of the connecting member is connected to the seat. The axle member is connected to the second end of the connecting member The axle member is movably disposed in the support member. The support member is capable of rotating with respect to the axle member. The axle member is capable of moving between a locked position and an unlocked position so as to restrain the support member from rotating.

In this embodiment, the bouncer can comprise a sleeve disposed in the support member. The axle member is movably disposed in the sleeve and engaged with the sleeve at the locked position so as to restrain the support member from rotating with respect to the axle member. The bouncer can further comprise a driving member rotatably disposed on the support member. The axle member has an engaging groove and the driving member has an engaging portion. The engaging portion of the driving member is engaged with the engaging groove of the axle member while the axle member is located at the locked position. The bouncer can further comprise a resilient member disposed between the driving member and the sleeve. The sleeve has an engaging groove and the axle member has an engaging portion. The engaging portion of the axle member is engaged with the engaging groove of the sleeve while the axle member is located at the locked position. The bouncer can further comprise a resilient part disposed between the axle member and the cover. The resilient part provides an elastic force for forcing the axle member to move toward the locked position. The bouncer can further comprise a cover disposed on one end of the support member. The second end of the connecting member passes through the cover and is connected to the axle member. Furthermore, the support member has a flat surface and a cambered surface opposite to the flat surface. The bouncer can further comprise a skidproof member disposed on the flat surface of the support member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
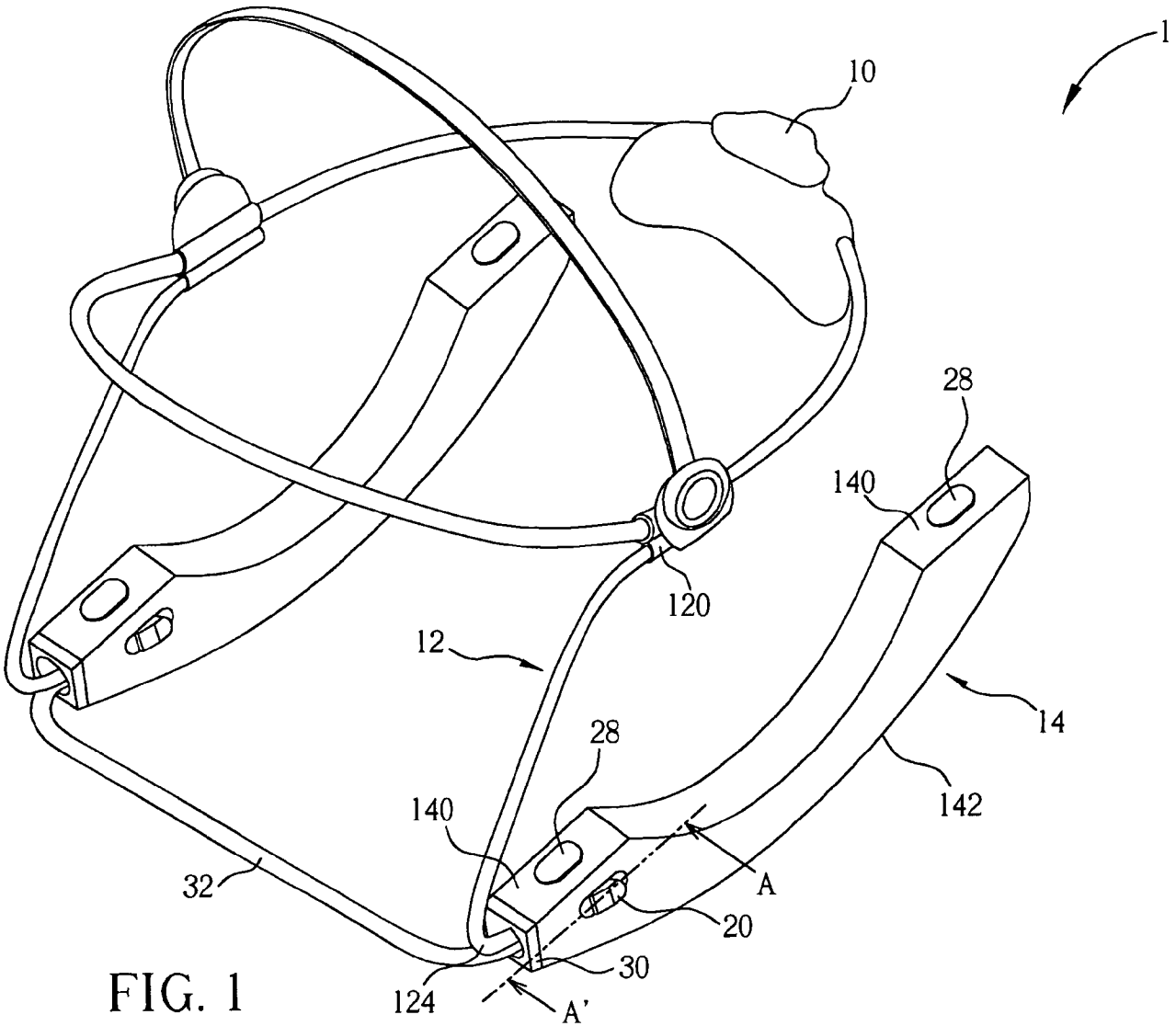
FIG. 1 is a perspective view illustrating a bouncer according to a first embodiment of the invention.
Figure 2:
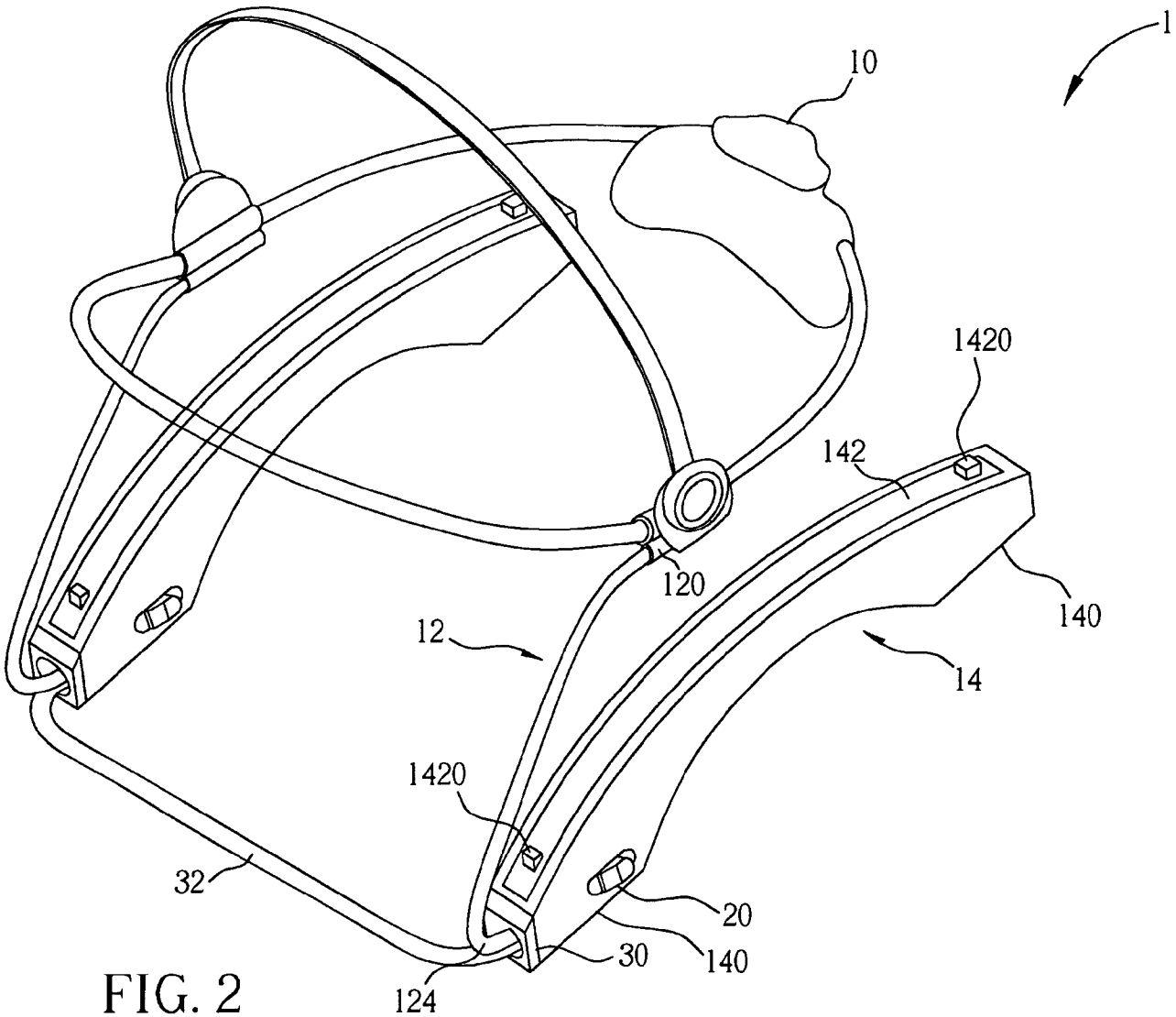
FIG. 2 is perspective view illustrating the support member shown in FIG. 1 being rotated with 180 degree.
Figure 3:
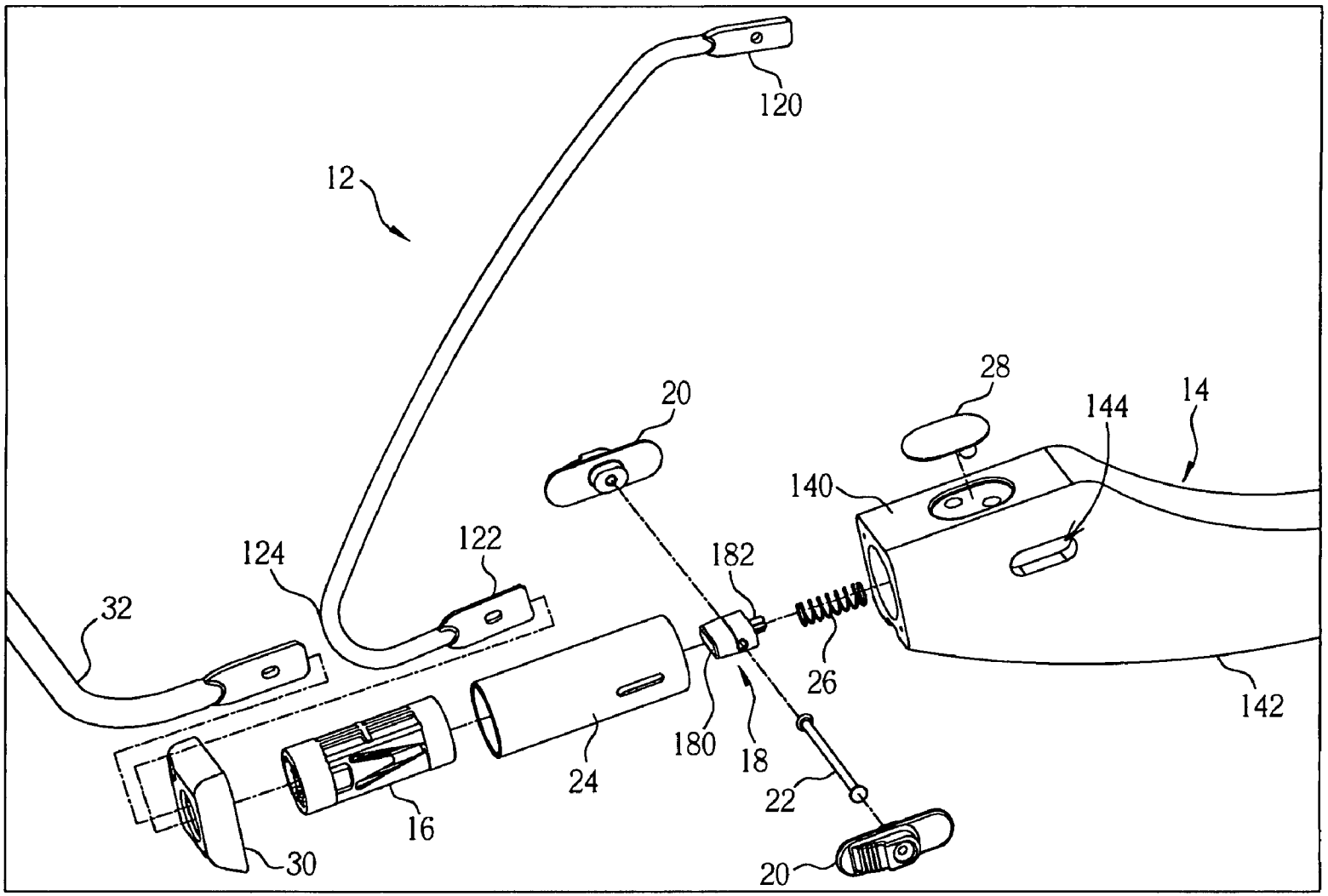
FIG. 3 is an exploded view illustrating partial components of the bouncer shown in FIG. 1.
Figure 4:
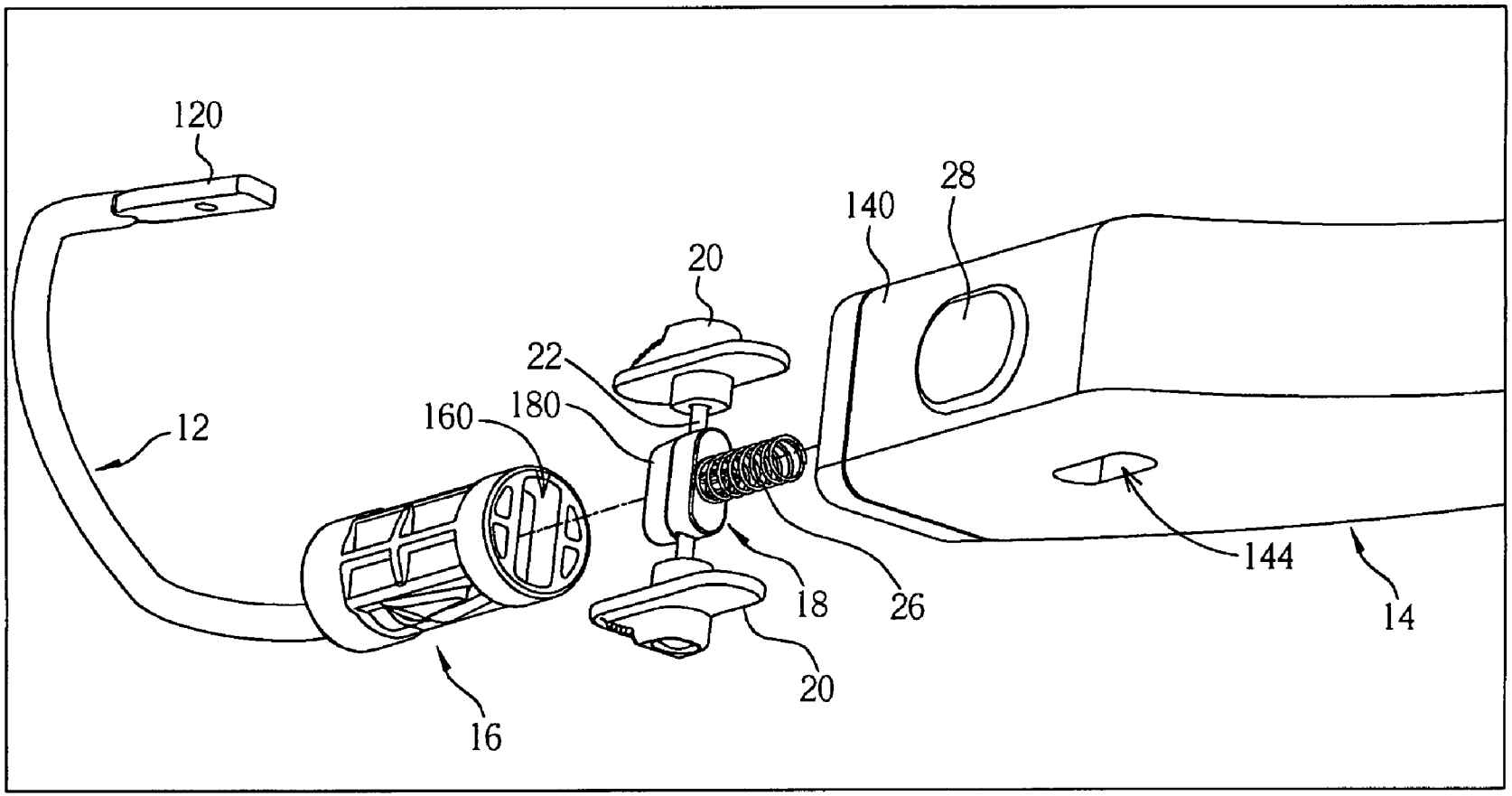
FIG. 4 is an exploded view illustrating partial components of the bouncer shown in FIG. 1.

As shown in FIGS. 1 and 2, the bouncer 1 is symmetrical. In the following, the structure of one side of the bouncer 1 along with the appended figures is taken for illustrative purpose. As shown in FIGS. 1 to 3, the bouncer 1 comprises a seat 10, which the fabric of the seat 10 is not shown in figures, a first connecting member 12, a support member 14, an axle member 16, an engaging member 18, two driving members 20, a second connecting member 22, a sleeve 24, a resilient member 26, a skidproof member 28, a cover 30, and a third connecting member 32.

The first connecting member 12 has a first end 120 and a second end 122. The first end 120 of the first connecting member 12 is connected to the seat 10, and the second end 122 is connected to the axle member 16, which is disposed in the support member 14. The first connecting member 12 has a bending portion 124 adjacent to the second end 122. Once the seat 10 is forced, the bending portion 124 of the first connecting member 12 will deform and then generate an elastic force to rebound the seat 10 upwardly, so that the seat 10 will bounce up and down.

The support member 14 has a flat surface 140 and a cambered surface 142 opposite to the flat surface 140. When the support member 14 is situated at the using state as shown in FIG. 1, the bouncer 1 stands on the plane by the cambered surface 142 of the support member 14, such that the bouncer 1 can rock and/or bounce on the plane. Furthermore, as shown in FIG. 2, both ends of the cambered surface 142 have a block portion 1420 respectively. The block portion 1420 is configured to restrain rock range of the bouncer 1 so as to prevent the bouncer 1 from being overturned. On the other hand, when the support member 14 is situated at the using state as shown in FIG. 2, the bouncer 1 stands on the plane in static state by the flat surface 140 of the support member 14, such that the bouncer 1 can only bounce on the plane. Moreover, the skidproof member 28 is disposed on the flat surface 140 so as to prevent the bouncer 1 from sliding due to collision or knock. Accordingly, the bouncer 1 can stand on the plane more stably.

Figure 5:
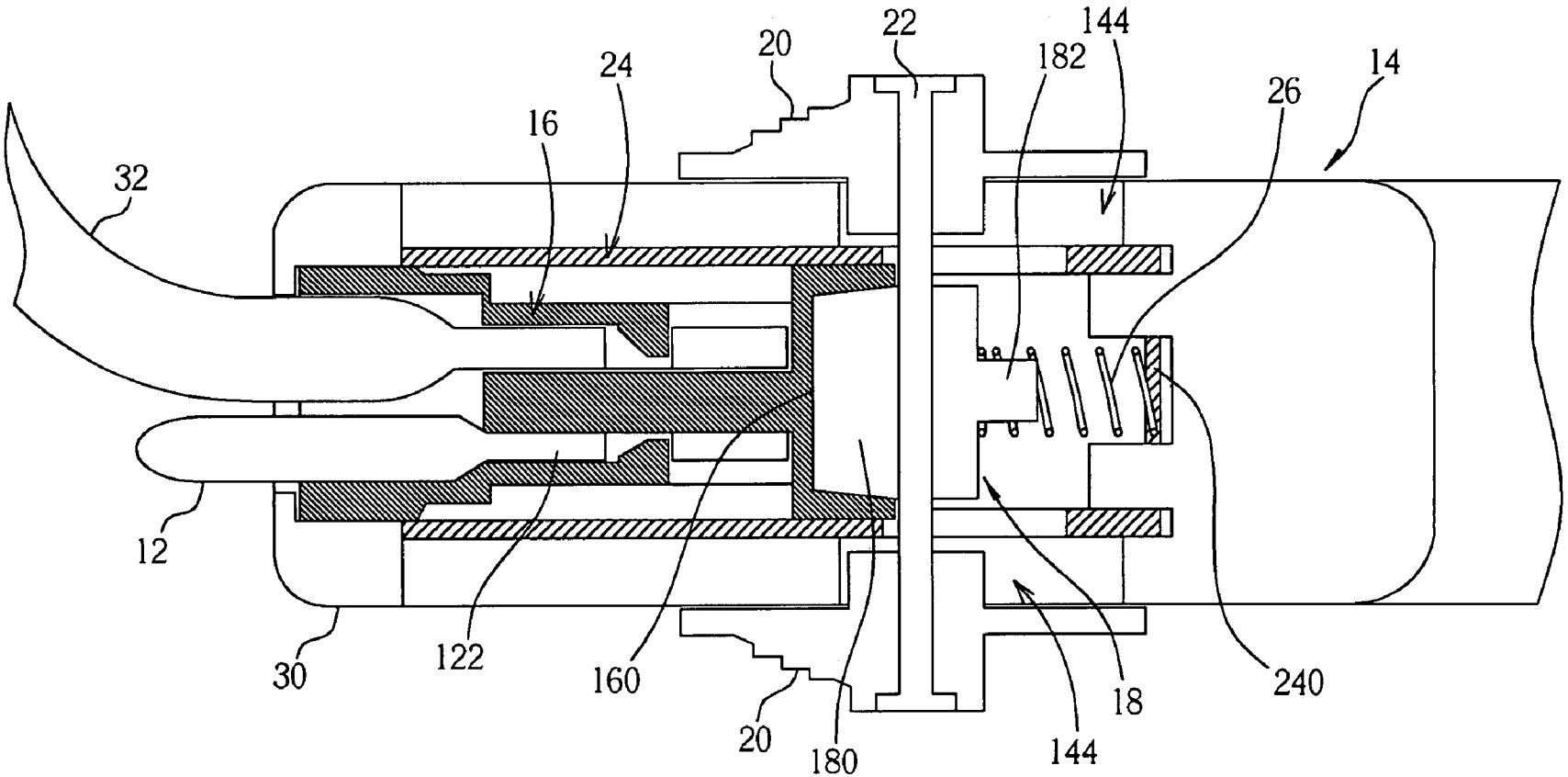
FIG. 5 is a sectional view illustrating the bouncer shown in FIG. 1 along line A-A', wherein the engaging member is located at a locked position.
Figure 6:
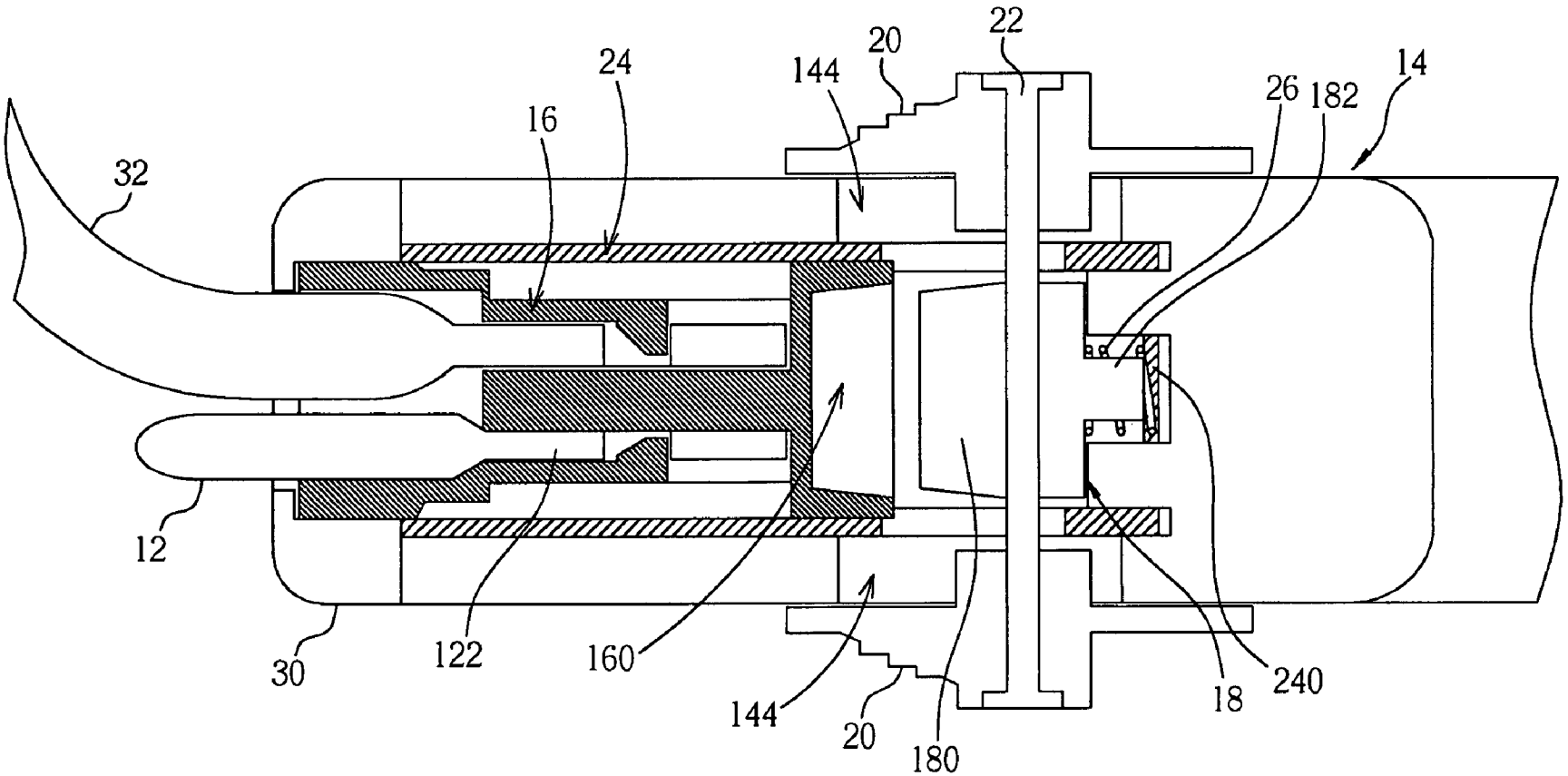
FIG. 6 is a sectional view illustrating the engaging member shown in FIG. 5 being located at an unlocked position.

As shown in FIG. 5, the sleeve 24 is disposed in the support member 14, and an outer surface of the sleeve 24 contacts an inner surface of the support member 14 tightly. That is to say, the sleeve 24 is fixed in the support member 14. The engaging member 18 is movably disposed in the sleeve 24 and capable of moving between a locked position (as shown in FIG. 5) and an unlocked position (as shown in FIG. 6) so as to be engaged with or released from the axle member 16. The cover 30 is disposed on one end of the support member 14. There is a recess formed on the inside of the cover 30, and the recess accommodates one end of the axle member 16. The third connecting member 32 and the second end 122 of the first connecting member 12 pass through a hole on the cover 30 and are connected to the axle member 16. The third connecting member 32 connects and fixes two support members 14 of the bouncer 1, as shown in FIGS. 1 and 2.

In this embodiment, there is an engaging groove 160 on the other end of the axle member 16, and the engaging member 18 has an engaging portion 180. When the engaging member 18 is located at the locked position as shown in FIG. 5, the engaging portion 180 of the engaging member 18 is engaged with the engaging groove 160 of the axle member 16. Accordingly, the bouncer 1 can maintain the using state as shown in FIG. 1 or 2. On the other hand, when the engaging member 18 is located at the unlocked position as shown in FIG. 6, the engaging portion 180 of the engaging member 18 is released from the engaging groove 160 of the axle member 16. Accordingly, the support member 14 can be rotated to change the using state of the bouncer 1.

There is a sliding groove 144 on both sides of the support member 14. Each of the two driving members 20 is movably disposed in the sliding groove 144 of the support member 14 correspondingly. The driving member 20 can be operated by a user to slide within the sliding groove 144. Furthermore, the second connecting member 22 connects the two driving members 20 and the engaging member 18. When the user slides the driving members 20 disposed on both sides of the support member 14, the driving members 20 will drive the engaging member 18 through the second connecting member 22 to move from the locked position (as shown in FIG. 5) to the unlocked position (as shown in FIG. 6). In this embodiment, the second connecting member 22 can be, but not limited to, a rivet.

The resilient member 26 is disposed between the engaging member 18 and an inner end 240 of the sleeve 24. As shown in FIG. 5, the engaging member 18 has a rib 182 on the other end opposite to the engaging portion 180. One end of the resilient member 26 is attached on the rib 182 of the engaging member 18, and the other end abuts against the inner end 240 of the sleeve 24. In this embodiment, the resilient member 26 provides an elastic force for forcing the engaging member 18 toward the locked position as shown in FIG. 5. In this embodiment, the resilient member 26 can be, but not limited to, a spring.

As shown in FIG. 5, when the engaging portion 180 of the engaging member 18 is engaged with the engaging groove 160 of the axle member 16, the engaging member 18 is restrained and cannot rotate with respect to the axle member 16. Accordingly, the bouncer 1 can maintain the using state as shown in FIG. 1 or 2. If a user wants to change the using state of the bouncer 1, he or she has to slide the driving members 20 so as to release the engaging portion 180 of the engaging member 18 from the engaging groove 160 of the axle member 16. At this time, the user can rotate the support member 14. Since the sleeve 24 is fixed in the support member 14, the support member 14 will rotate together with the sleeve 24, the engaging member 18, the driving members 20, the second connecting member 22, the resilient member 26, the skidproof member 28, and the cover 30. In other words, during the rotation of the support member 14, the axle member 16, the first connecting member 12, and the third connecting member 13 will stay in static state. After rotating the support member 14 with 180 degree, the resilient member 26, which has been compressed early, will provide an elastic force for forcing the engaging portion 180 of the engaging member 18 into the engaging groove 160 of the axle member 16 so as to lock the support member 14. Since the support member 14 has the flat surface 140 and the cambered surface 142, the bouncer 1 can stand on the plane by the flat surface 140 or the cambered surface 142 after rotating the support member 14 so as to be situated at different using states (as shown in FIGS. 1 and 2).

Figure 7:
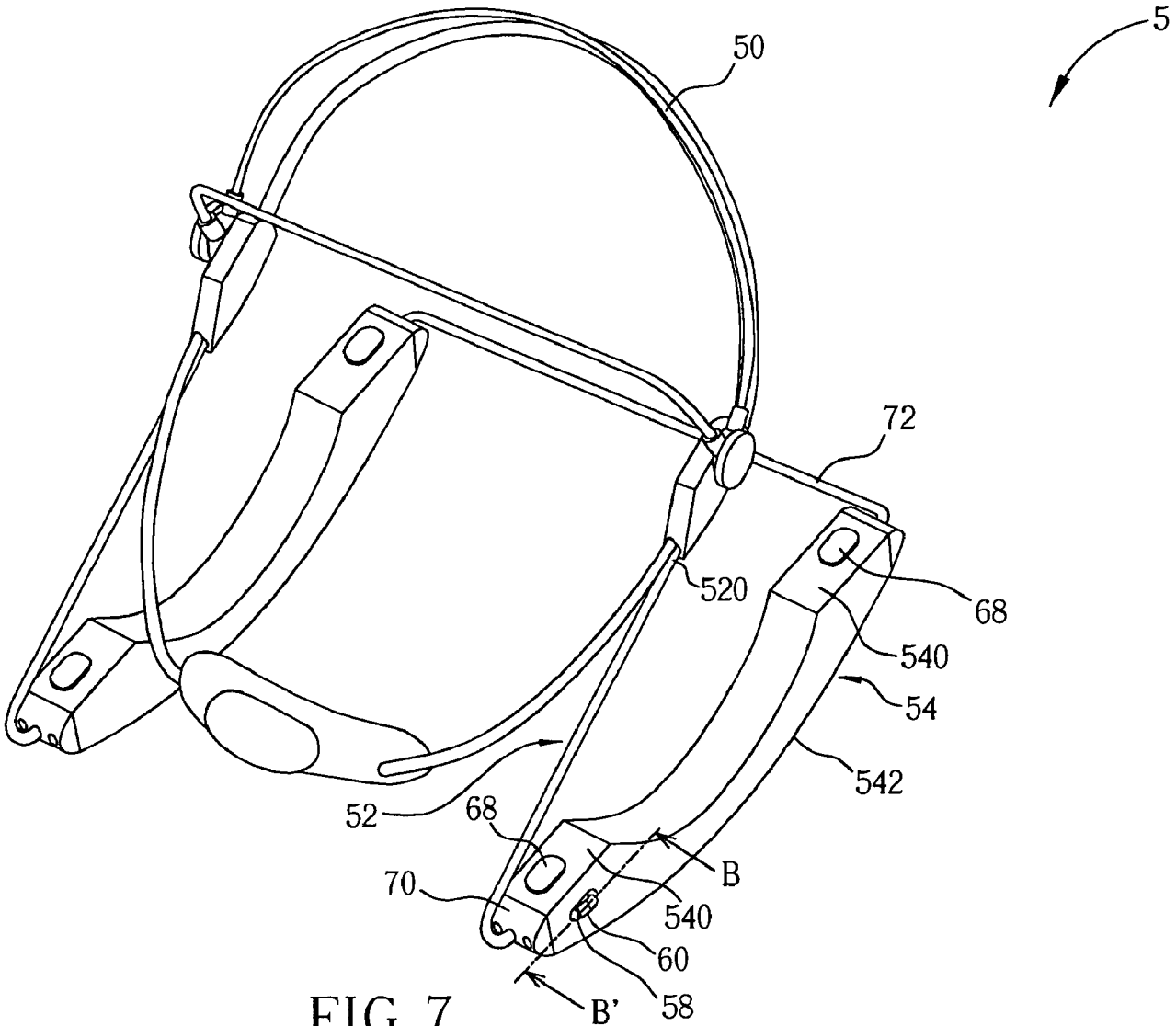
FIG. 7 is a perspective view illustrating a bouncer according to a second embodiment of the invention.
Figure 8:
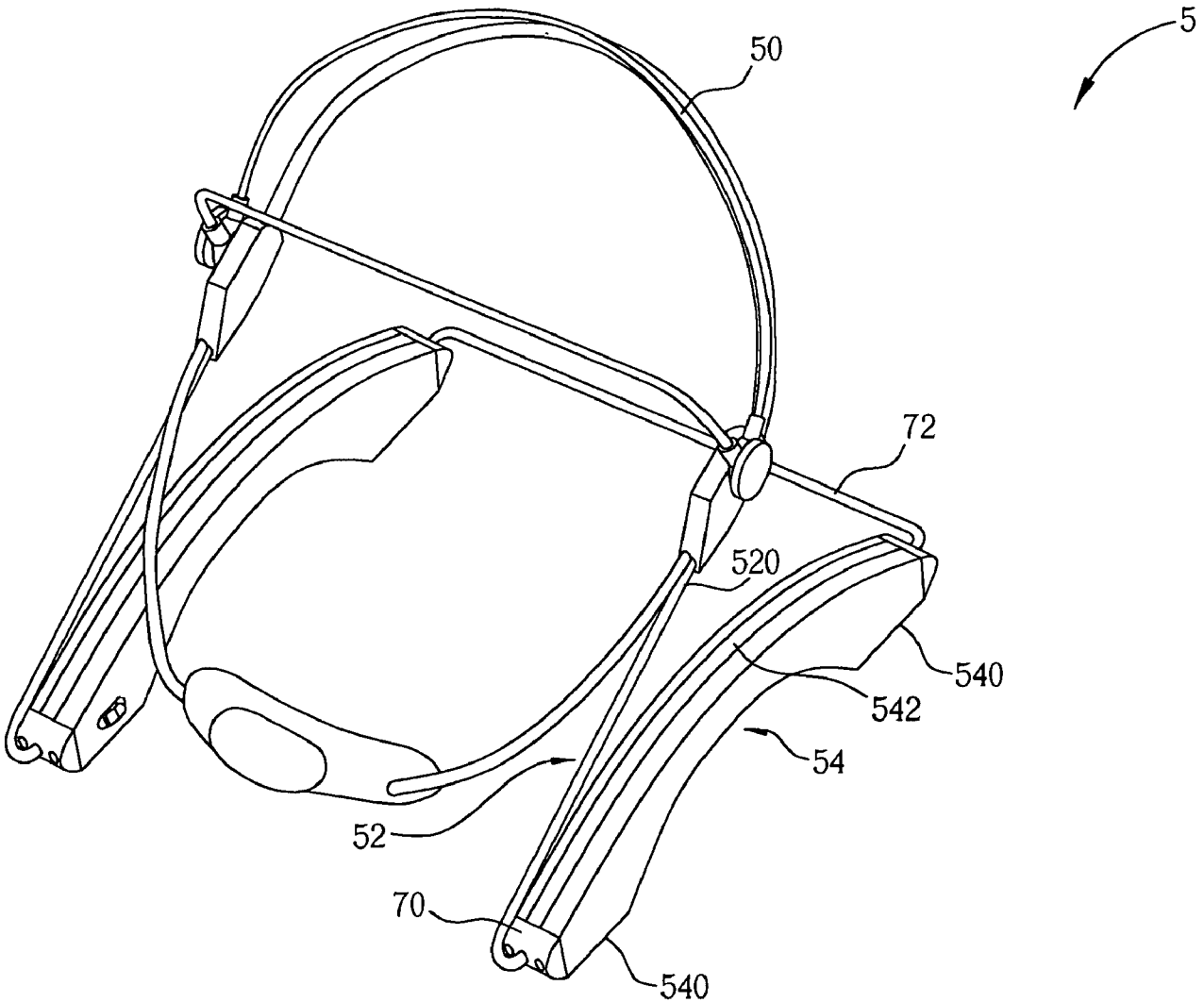
FIG. 8 is perspective view illustrating the support member shown in FIG. 7 being rotated with 180 degree.
Figure 9:
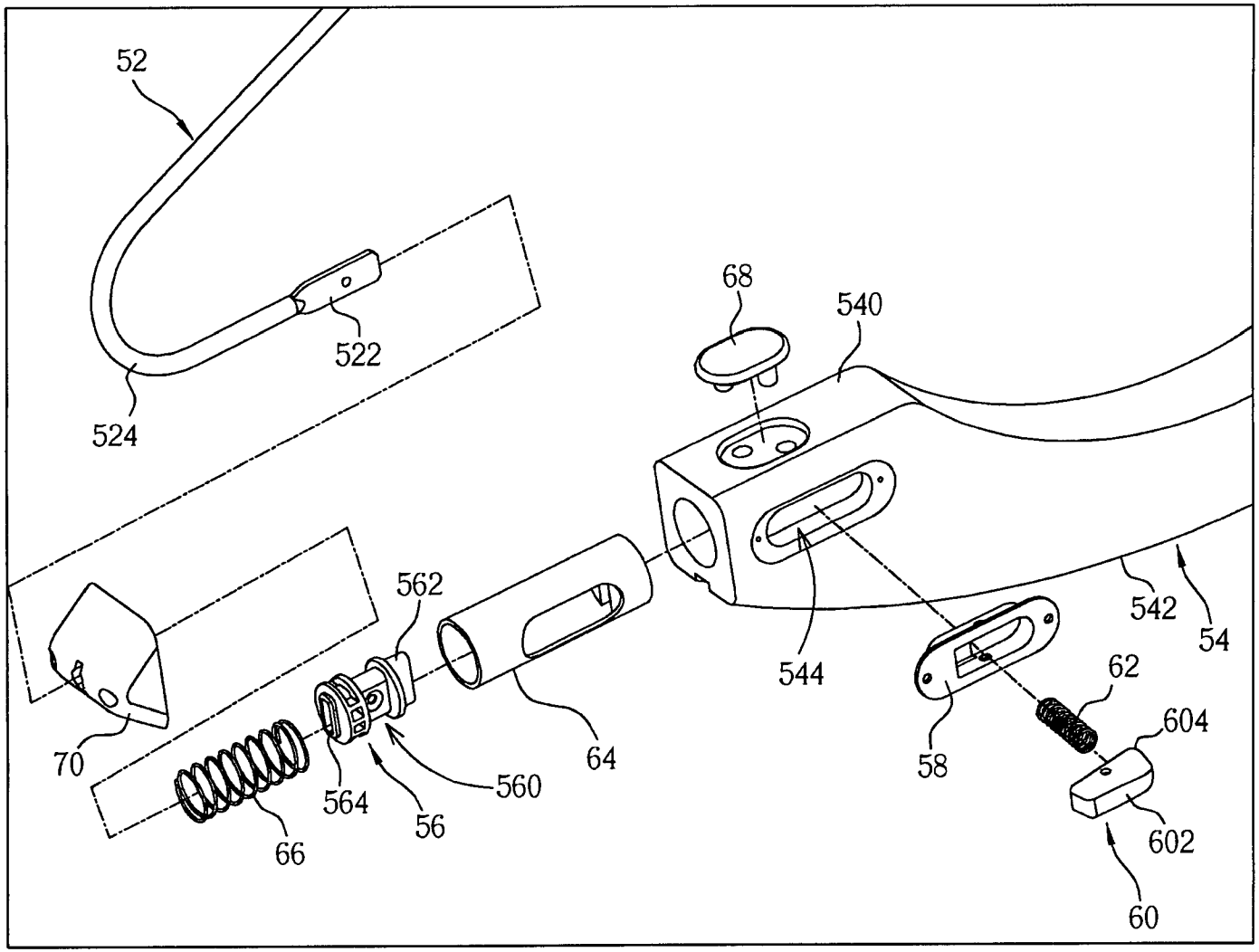
FIG. 9 is an exploded view illustrating partial components of the bouncer shown in FIG. 7.
Figure 10:
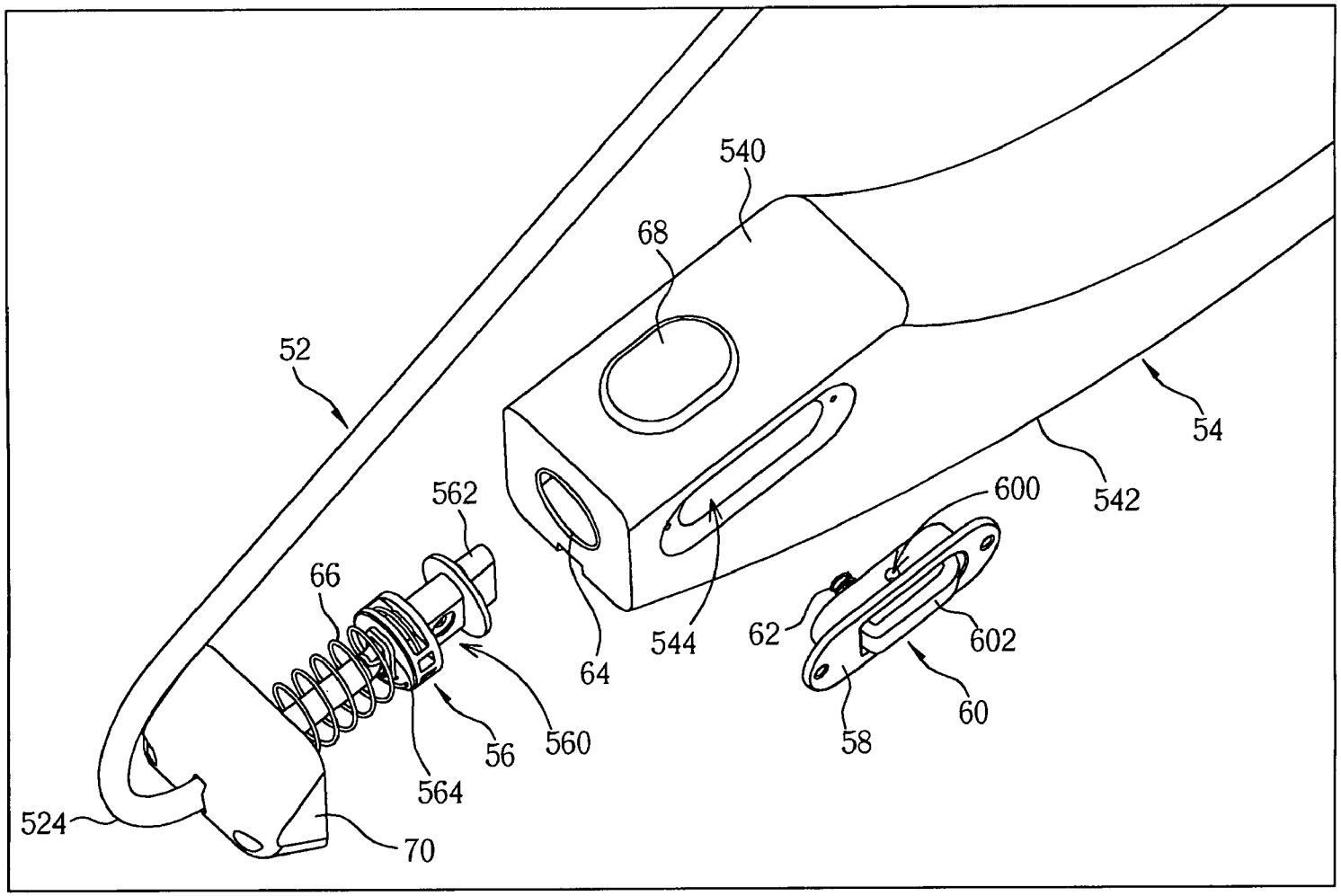
FIG. 10 is an exploded view illustrating partial components of the bouncer shown in FIG. 7.

As shown in FIGS. 7 to 9 according to a second embodiment of the invention, the bouncer 5 is symmetrical. In the following, the structure of one side of the bouncer 5 along with the appended figures is taken for illustrative purpose. As shown in FIGS. 7 to 9, the bouncer 5 comprises a seat 50, a connecting member 52, a support member 54, an axle member 56, an engaging/sliding groove 58, a driving member 60, a resilient member 62, a sleeve 64, a resilient part 66, a skidproof member 68, a cover 70, and a fixing/connecting member 72.

The connecting member 52 has a first end 520 and a second end 522. The first end 520 of the connecting member 52 is connected to the seat 50, and the second end 522 is connected to the axle member 56, which is disposed in the support member 54. The connecting member 52 has a bending portion 524 adjacent to the second end 522. Once the seat 50 is forced, the bending portion 524 of the connecting member 52 will deform and then generate an elastic force to rebound the seat 50 upwardly, so that the seat 50 will bounce.

The support member 54 has a flat surface 540 and a cambered surface 542 opposite to the flat surface 540. When the support member 54 is situated at the using state as shown in FIG. 7, the bouncer 5 stands on the plane by the cambered surface 542 of the support member 54, such that the bouncer 5 can rock and/or bounce on the plane. On the other hand, when the support member 54 is situated at the using state as shown in FIG. 8, the bouncer 5 stands on the plane in static state by the flat surface 540 of the support member 54, such that the bouncer 5 can only bounce on the plane. Moreover, the skidproof member 68 is disposed on the flat surface 540 so as to prevent the bouncer 5 from sliding due to collision or knock. Accordingly, the bouncer 5 can stand on the plane more stably.

Figure 11:
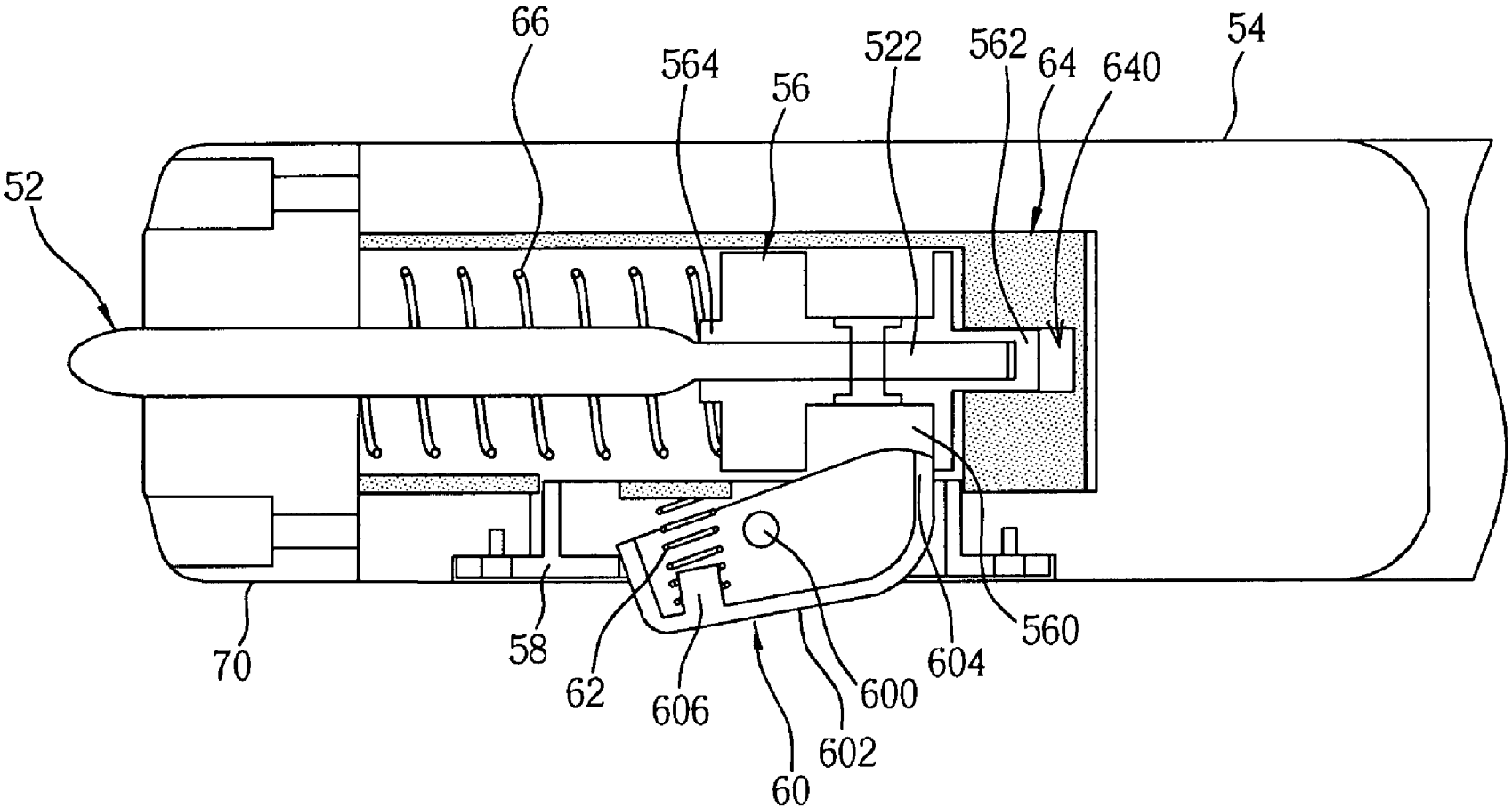
FIG. 11 is a sectional view illustrating the bouncer shown in FIG. 7 along line B-B', wherein the axle member is located at a locked position.
Figure 12:
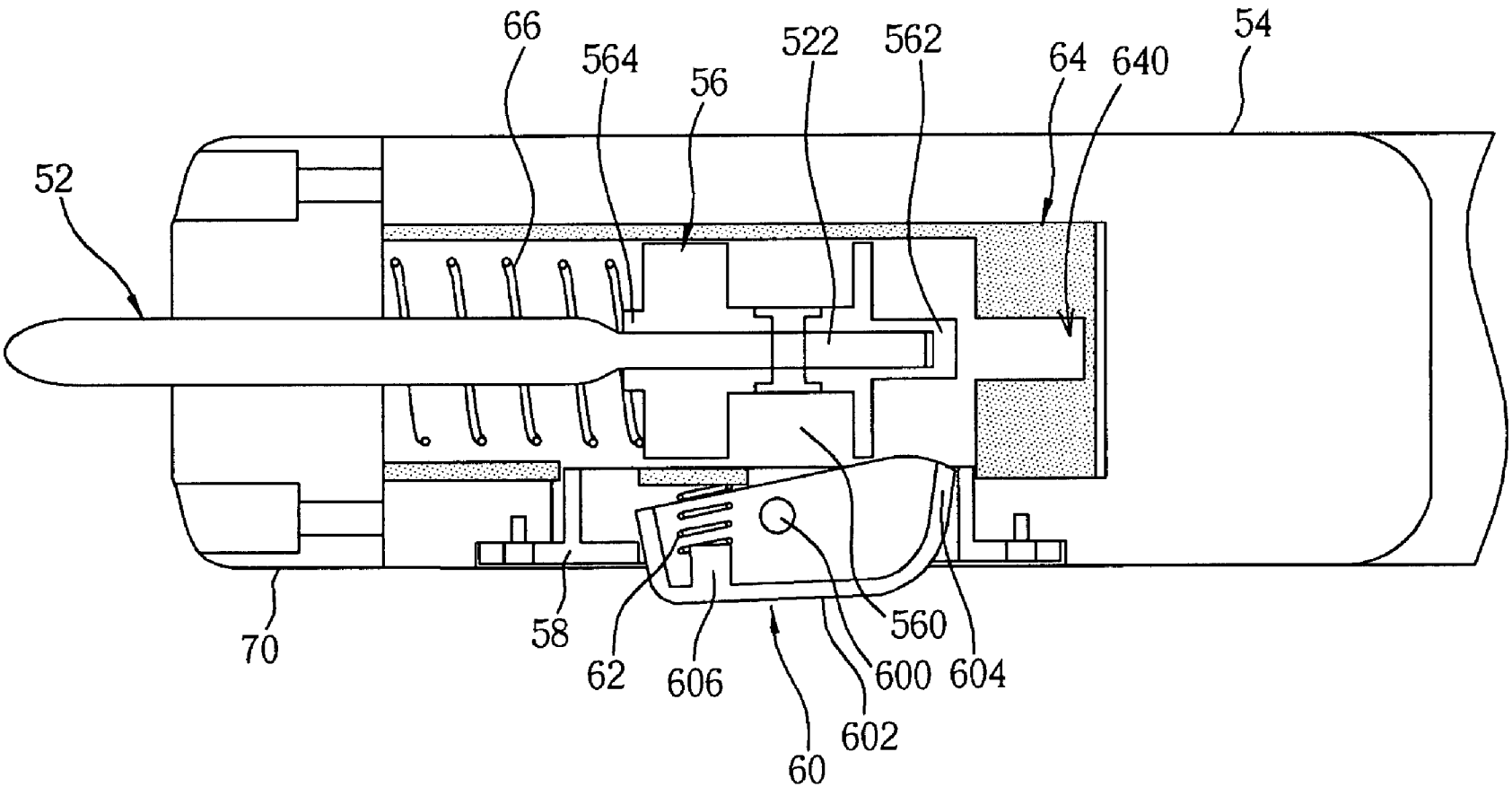
FIG. 12 is a sectional view illustrating the axle member shown in FIG. 11 being located at an unlocked position.

As shown in FIG. 11, the sleeve 64 is disposed in the support member 54, and an outer surface of the sleeve 64 contacts an inner surface of the support member 54 tightly. That is to say, the sleeve 64 is fixed in the support member 54. The axle member 56 is disposed in the sleeve 64 and capable of moving between a locked position (as shown in FIG. 11) and an unlocked position (as shown in FIG. 12) so as to be engaged with or released from the sleeve 64. The cover 70 is disposed on one end of the support member 54. The second end 522 of the connecting member 52 passes through a hole on the cover 70 and are connected to the axle member 56. Furthermore, the fixing/connecting member 72 connects and fixes two support members 54 of the bouncer 5, as shown in FIGS. 7 and 8.

In this embodiment, there is an engaging groove 544 formed on one side of the support member 54, and the engaging/sliding groove 58 is disposed in the engaging groove 544. The driving member 60 is pivotally connected to the engaging/sliding groove 58 at a pivot 600. A user can press a press portion 602 of the driving member 60 to make the driving member 60 rotate with respect to the engaging/sliding groove 58. Furthermore, the axle member 56 has an engaging groove 560, and the driving member 60 has an engaging portion 604. When the axle member 56 is located at the locked position as shown in FIG. 11 and the press portion 602 of the driving member 60 does not be pressed yet, the engaging portion 604 of the driving member 60 is engaged with the engaging groove 560 of the axle member 56. As shown in FIGS. 11 and 12, one end of the resilient member 62 is attached on a rib 606 inside the driving member 60, and the other end abuts against an outer edge of the sleeve 64. When pressing the press portion 602 of the driving member 60, the resilient member 62 provides an elastic force for the driving member 60 due to compression. In this embodiment, the resilient member 62 can be, but not limited to, a spring.

There is an engaging groove 640 inside the sleeve 64, and the axle member 56 has an engaging portion 562. When the axle member 56 is located at the locked position as shown in FIG. 11, the engaging portion 562 of the axle member 56 is engaged with the engaging groove 640 of the sleeve 64. Accordingly, the bouncer 5 can maintain the using state as shown in FIG. 7 or 8. On the other hand, when the axle member 56 is located at the unlocked position as shown in FIG. 12, the engaging portion 562 of the axle member 56 is released from the engaging groove 640 of the sleeve 64. Accordingly, the support member 54 can be rotated to change the using state of the bouncer 5.

The resilient part 66 is disposed between the axle member 56 and the cover 70. As shown in FIG. 11, the axle member 56 has a rib 564 on the other end opposite to the engaging portion 562 of the axle member 56. One end of the resilient part 66 is attached on the rib 564 of the axle member 56, and the other end abuts against the cover 70. In this embodiment, the resilient part 66 provides an elastic force for forcing the axle member 56 toward the locked position as shown in FIG. 11. In this embodiment, the resilient part 66 can be, but not limited to, a spring.

As shown in FIG. 11, when the engaging portion 562 of the axle member 56 is engaged with the engaging groove 640 of the sleeve 64, the bouncer 5 can maintain the using state as shown in FIG. 7 or 8. If a user wants to change the using state of the bouncer 5, he or she has to press the press portion 602 of the driving member 60 so as to release the engaging portion 604 of the driving member 60 from the engaging groove 560 of the axle member 56. At this time, the resilient member 62 is compressed. Then, the user can pull the connecting member 52 to slide the axle member 56, such that the engaging portion 562 of the axle member 56 is released from the engaging groove 640 of the sleeve 64. At this time, the resilient part 66 is compressed. Consequently, the user can rotate the support member 54.

Since the sleeve 64 is fixed in the support member 54, the support member 54 will rotate together with the sleeve 64, the engaging/sliding groove 58, the driving member 60, the resilient member 62, the resilient part 66, the skidproof member 68, and the cover 70. In other words, during the rotation of the support member 54, the axle member 56, the connecting member 52, and the fixing/connecting member 72 will stay in static state. After rotating the support member 54 with 180 degree, the resilient part 66, which has been compressed early, will provide an elastic force for forcing the engaging portion 562 of the axle member 56 into the engaging groove 640 of the sleeve 64 while the user release the connecting member 52. Afterward, the resilient member 62, which has been compressed early, will provide an elastic force for forcing the engaging portion 604 of the driving member 60 into the engaging groove 560 of the axle member 56 while the user release the driving member 60. Consequently, the support member 54 is locked. Since the support member 54 has the flat surface 540 and the cambered surface 542, the bouncer 5 can stand on the plane by the flat surface 540 or the cambered surface 542 after rotating the support member 54 so as to be situated at different using states (as shown in FIGS. 7 and 8).

Compared with the prior art, since the bouncer of the invention is equipped with a reversible support member, the bouncer can rock on a plane or stand on the plane in static state. Furthermore, the operation of changing the using state of the bouncer is very easy for the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bouncer comprising:

a seat;

a first connecting member having a first end and a second end, the first end being connected to the seat;

a support member reversibly connected to the second end of the first connecting member and having a flat surface and a cambered surface opposite to the flat surface, for selectively supporting the seat on a plane by the flat surface or the cambered surface; and an engaging member movably disposed in the support member and capable of moving between a locked position and an unlocked position so as to selectively restrain the support member from rotating.

2. The bouncer of claim 1, further comprising a driving member movably disposed on the support member, wherein the driving member is capable of driving the engaging member to move from the locked position to the unlocked position.

3. The bouncer of claim 2, further comprising a second connecting member connecting the driving member and the engaging member.

4. The bouncer of claim 1, further comprising an axle member disposed in the support member and connected to the second end of the first connecting member, wherein the engaging member is engaged with the axle member at the locked position so as to restrain the support member from rotating with respect to the axle member.

5. The bouncer of claim 4, wherein the axle member has an engaging groove and the engaging member has an engaging portion, the engaging portion is engaged with the engaging groove while the engaging member is located at the locked position.

6. The bouncer of claim 4, further comprising a sleeve disposed in the support member, wherein the axle member is disposed in the sleeve, the sleeve is capable of rotating with respect to the axle member, and the engaging member is movably disposed in the sleeve.

7. The bouncer of claim 6, further comprising a resilient member disposed between the engaging member and an inner end of the sleeve, wherein the resilient member provides an elastic force for forcing the engaging member to move toward the locked position.

8. The bouncer of claim 4, further comprising a cover disposed on one end of the support member, wherein the second end of the first connecting member passes through the cover and is connected to the axle member.

9. The bouncer of claim 1, further comprising a skidproof member disposed on the flat surface.

10. The bouncer of claim 1, wherein the cambered surface has a block portion formed thereon.

11. A bouncer comprising:

a seat;

a connecting member having a first end and a second end, the first end being connected to the seat;

an axle member connected to the second end of the connecting member; and a support member having a flat surface and a cambered surface opposite to the flat surface, the axle member being movably disposed in the support member, the support member being reversible with respect to the axle member for selectively supporting the seat on a plane by the flat surface or the cambered surface, the axle member being capable of moving between a locked position and an unlocked position so as to restrain the support member from rotating.

12. The bouncer of claim 11, further comprising a sleeve disposed in the support member, wherein the axle member is movably disposed in the sleeve and engaged with the sleeve at the locked position so as to restrain the support member from rotating with respect to the axle member.

13. The bouncer of claim 12, further comprising a driving member rotatably disposed on the support member, wherein the axle member has a an engaging groove and the driving member has an engaging portion, the engaging portion of the driving member is engaged with the engaging groove of the axle member while the axle member is located at the locked position.

14. The bouncer of claim 13, further comprising a resilient member disposed between the driving member and the sleeve.

15. The bouncer of claim 12, wherein the sleeve has an engaging groove and the axle member has an engaging portion, the engaging portion of the axle member is engaged with the engaging groove of the sleeve while the axle member is located at the locked position.

16. The bouncer of claim 11, further comprising a skidproof member disposed on the flat surface.

17. The bouncer of claim 11, further comprising a cover disposed on one end of the support member, wherein the second end of the connecting member passes through the cover and is connected to the axle member.

18. The bouncer of claim 17, further comprising a resilient part disposed between the axle member and the cover, wherein the resilient part provides an elastic force for forcing the axle member to move toward the locked position.

* * * * *